US010484786B1

(12) United States Patent
Hsu Huang et al.

(10) Patent No.: US 10,484,786 B1
(45) Date of Patent: Nov. 19, 2019

(54) VIBRATION-BASED SPEAKER BOX DEVICE

(71) Applicant: JAZZ HIPSTER CORPORATION, New Taipei (TW)

(72) Inventors: Yueh-Hua Hsu Huang, New Taipei (TW); Chen-Ti Chen, New Taipei (TW)

(73) Assignee: JAZZ HIPSTER CORPORATION, New Taipei (TW)

( * ) Notice: Subject to any disclaimer, the term of this patent is extended or adjusted under 35 U.S.C. 154(b) by 0 days.

(21) Appl. No.: 16/237,972

(22) Filed: Jan. 2, 2019

(51) Int. Cl.

| | |
|---|---|
| ***H04R 1/00*** | (2006.01) |
| ***H04R 1/28*** | (2006.01) |
| ***H04R 9/06*** | (2006.01) |
| ***H04R 1/02*** | (2006.01) |
| ***H04R 9/04*** | (2006.01) |

(52) U.S. Cl.
CPC ..... *H04R 1/2811* (2013.01); *H04R 1/02* (2013.01); *H04R 1/288* (2013.01); *H04R 9/04* (2013.01); *H04R 9/06* (2013.01)

(58) Field of Classification Search
CPC .. H04R 17/00; H04R 17/005; H04R 2499/11; H04R 2499/15
See application file for complete search history.

(56) References Cited

U.S. PATENT DOCUMENTS

2006/0239479 A1* 10/2006 Schobben ..... H04M 1/0266 381/306
2015/0126112 A1* 5/2015 Park ..... B06B 1/06 455/41.1
2015/0245145 A1* 8/2015 Horii ..... H04R 7/045 381/98
2016/0014525 A1* 1/2016 Park ..... H04R 17/00 381/190

* cited by examiner

*Primary Examiner* — Matthew A Eason
(74) *Attorney, Agent, or Firm* — Muncy, Geissler, Olds & Lowe, P.C.

(57) ABSTRACT

A vibration-based speaker box device is disclosed, comprising a vibration body and a control body, wherein the vibration body can be combined with the control body, and the control body can transfer an audio signal to the vibration body; the first case of the vibration body internally includes an accommodation area for the placement of the a vibrator, and the vibrator can be combined within the accommodation area by means of the filler between the accommodation area and the vibrator; also, the surface of the vibrator can be fixedly bonded onto a vibration board, so that the kinetic energy generated by the vibrations of the vibration body can spread onto the entire vibration board thereby propagating the audio signal through the vibration board.

11 Claims, 6 Drawing Sheets

VIBRATION-BASED SPEAKER BOX DEVICE

BACKGROUND OF THE INVENTION

1. Field of the Invention

The present invention generally relates to a vibration-based speaker box device; in particular, it relates to a speaker box device capable of propagating audio signals by way of vibrations.

2. Description of Related Art

It is well-known that the sound generated by the currently available speaker boxes is reproduced by the conventional speaker which essentially comprises a magnetic circuit system, a vibration system as well as a suspension system for supporting vibrations, wherein the magnetic circuit system includes a washer, a magnet and a U-shaped iron; the vibration system includes a sound coil, a supporting frame and a diaphragm; and the suspension system mainly consists of a corrugated rim located around the peripheral edge of the diaphragm in the speaker and a damper for fixing the sound coil.

Herein the sound coil oscillates in the magnetic gap created by the magnetic circuit system, and the operational principle of the above-mentioned speaker can be largely explained as below: transferring alternating current implicitly comprising audio signals to the sound coil in order to cause the sound coil to vibrate vertically in the magnetic gap, and making the vibrations of the sound coil bring the diaphragm to move by means of the framework such that the diaphragm vibrates up-down and compresses the air in order to reproduce the sound.

However, the transfer range of the sound generated by the vibrations in each speaker is limited; as such, it would be an optimal solution suppose it is possible to develop a sort of speaker box device which can fix the surface of a vibrator onto a vibration board in contact, and when the vibrator operates, the generated vibrations can spread out on the vibration board because of the fixed contact between the vibrator and the vibration board thereby effectively increasing its acoustic transfer range.

SUMMARY OF THE INVENTION

A vibration-based speaker box device according to the present invention comprises: a vibration body, including: a first case, formed with an accommodation area; a vibrator, placed within the accommodation area and having at least a contact board, a supporting frame, a sound coil wound around the lateral surface of the supporting frame, a damper and a magnetic package, in which the lower part of the contact board is connected to the supporting frame, the supporting frame can be placed within the magnetic package, and one end of the damper is connected to the lateral surface of the supporting frame while the other end thereof is connected to the lateral edge of the magnetic package; a filler, placed between the accommodation area and the vibrator so that, through which, the vibrator can be combined within the accommodation area; in which the contact board of the vibrator can be fixedly bonded onto a vibration board and, after bringing the damper to vibrate by means of the sound coil of the vibrator, it is possible to make the magnetic package vibrate conjunctively, and the vibration can be further transferred to the entire vibration body via the filler such that the vibration board in contact with the vibrator can spread the kinetic energy generated by the vibrations of the vibration body onto the whole vibration board; a control body, including: a second case, connected to the first case; an electric circuit board, set up within the second case and electrically connected to the vibrator of the vibration body; and a battery, installed within the second case and electrically connected to the electric circuit board; in which the control body can send an audio signal to the vibration body so as to, by means of the vibrations of the vibration body, spread the audio signal through the vibration board.

More specifically, the contact board of the vibrator is a metal plate or a plastic board.

More specifically, the filler is a rubber, a sponge, an ethylene vinyl acetate copolymer, or a mixture containing at least two of the above-mentioned materials.

More specifically, the vibration board is a wooden board, a glass plate, a metal plate or a plastic board.

More specifically, the surface of the vibration board can be a flat surface or a non-flat surface.

More specifically, the surface on the other side of the first case in the vibration body is combined with a binding component thereby allowing the vibration body to be attached in binding onto the surface of the vibration board.

More specifically, a combination part protrudes outwards from one lateral surface of the first case in the vibration body, while an accommodation part is formed on the other lateral surface of the first case in the vibration body in correspondence with the combination part, and a connection part is further concavely configured on the control body in correspondence with the combination part of the vibration body, in which the connection part internally includes a second connection end, and the first connection end and the second connection end can engage to form an electric connection.

More specifically, the vibrator of the vibration body is electrically connected to a first connection end, the electric circuit board of the control body is electrically connected to the second connection end, and the control body can transfer the audio signal to the second connection end via the connection of the second connection end and the first connection end.

More specifically, the first case and the second case can be fixedly connected or detachably connected.

More specifically, one side on the second case of the control body is further configured with a touch area which can be pressed thereby generating and transferring a signal to the electric circuit board.

More specifically, the inside of the electric circuit board further includes a wireless connection module and/or a wired connection plug which can be used to transfer information, i.e., the audio signals and/or control signals, to the control body by way of a wireless connection and/or a wired connection.

DETAILED DESCRIPTION OF THE PREFERRED EMBODIMENTS

Figure 1:
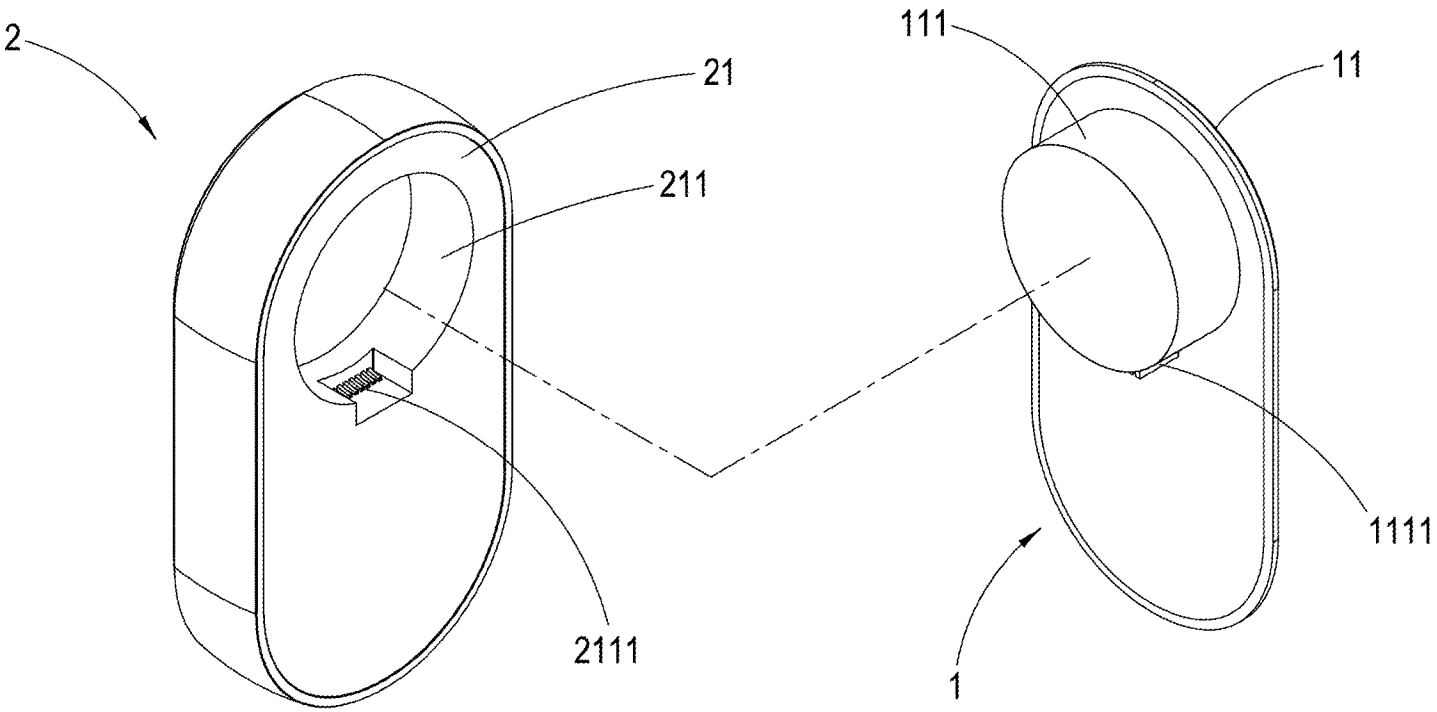
FIG. 1 shows a disassembled structural view of the vibration-based speaker box device according to the present invention.
Figure 2:
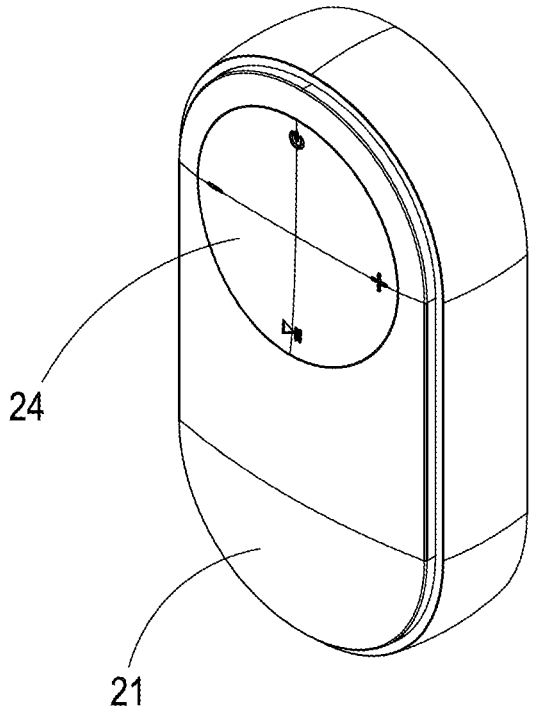
FIG. 2 shows an assembled structural view of the vibration-based speaker box device according to the present invention.
Figure 3:
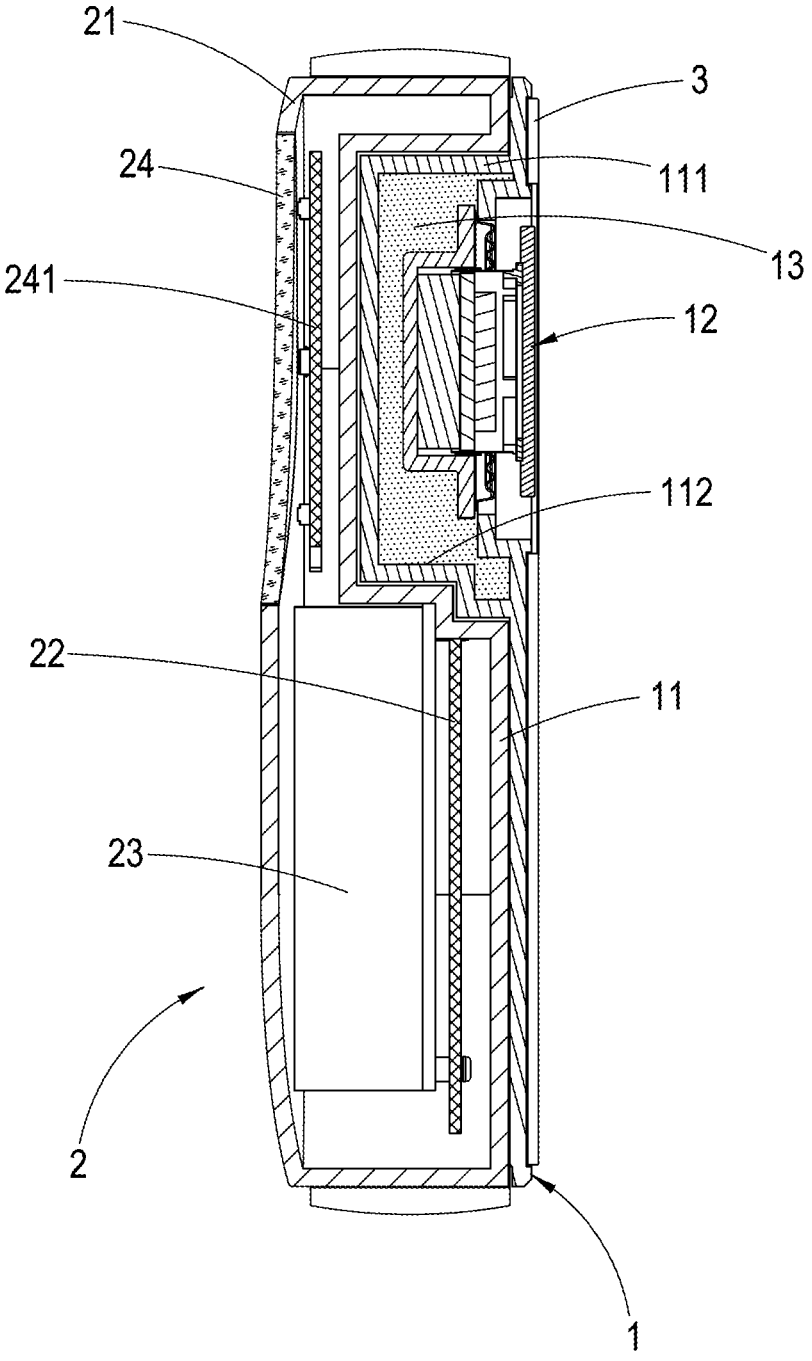
FIG. 3 shows a cross-sectioned structural view of the vibration-based speaker box device according to the present invention.
Figure 4:
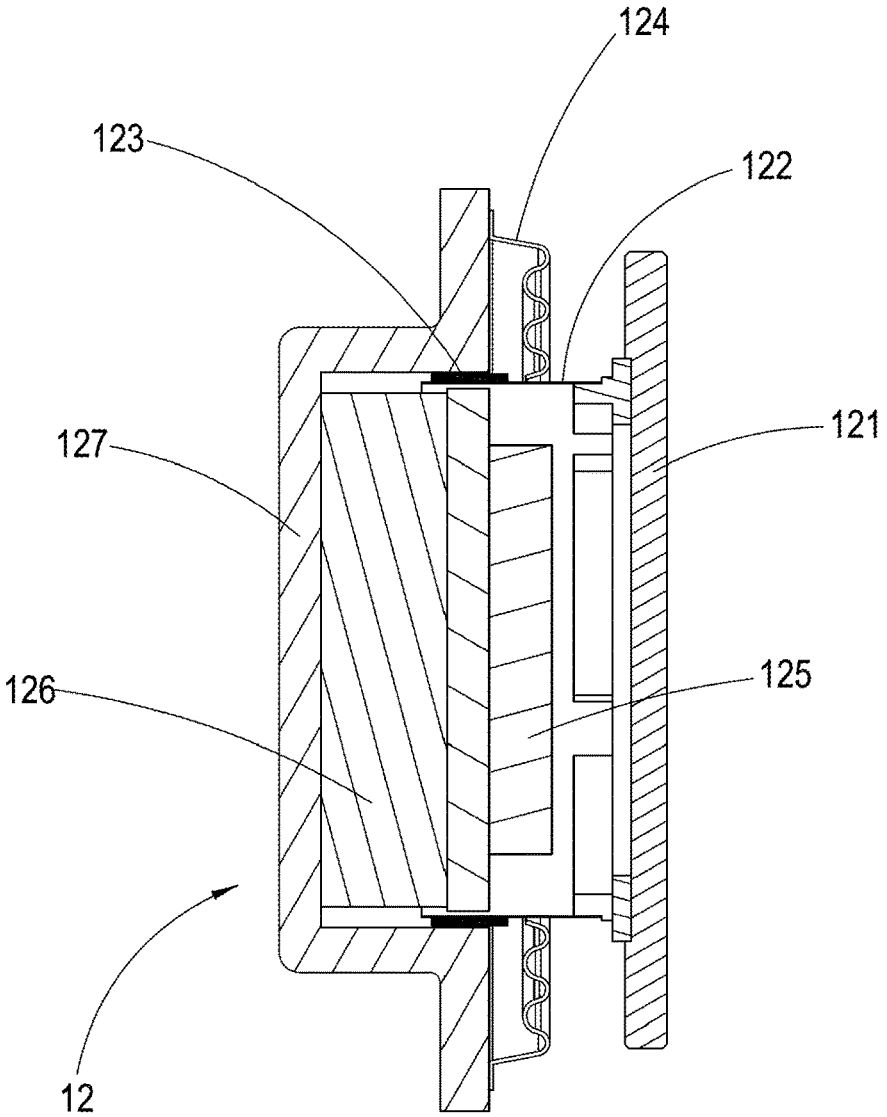
FIG. 4 shows a partially cross-sectioned structural view of the vibration-based speaker box device according to the present invention.

Other technical contents, aspects and effects in relation to the present invention can be clearly appreciated through the detailed descriptions concerning the preferred embodiments of the present invention in conjunction with the appended drawings.

Refer first to FIGS. 1-4, wherein a disassembled structural view, an assembled structural view, a cross-sectioned structural view and a partially cross-sectioned structural view of the vibration-based speaker box device according to the present invention are respectively shown. It can be seen from the Figures that the illustrated vibration-based speaker box device comprises a vibration body 1 and a control body 2.

Herein the vibration body 1 includes at least a first case 11, a vibrator 12 and a filler 13, and a combination part 111 protrudes from one lateral surface of the first case 11, while an accommodation part 112 is formed on the other lateral surface of the first case 11 in correspondence with the combination part 111.

In addition, the vibrator 12 is placed within the accommodation area 112 and electrically connected to the first connection end 1111, and has at least a contact board 121, a supporting frame 122, a sound coil 123 wound around the lateral surface of the supporting frame122, a damper 124 and a magnetic package (consisting of a washer 125, a magnet 126 and a U-shaped iron 127), in which the contact board 121 is a metal plate or a plastic board, and the lower part of the contact board 121 is connected to the supporting frame 122, the supporting frame 122 can be placed within the U-shaped iron 127 of the magnetic package, and one end of the damper 124 is connected to the lateral surface of the supporting frame 122, while the other end of the damper 124 is connected to the lateral edge of U-shaped iron 127 in the magnetic package.

Moreover, the filler 13 is placed between the accommodation area 112 and the vibrator 12 so that, through the filler 13, the vibrator 12 can be combined within the accommodation area 112; also, the filler 13 is a rubber, a sponge, an ethylene vinyl acetate copolymer, or a mixture containing at least selected two of the above-mentioned materials.

Herein the control body 2 includes a second case 21, an electric circuit board 22, a battery 23 and a touch electric circuit board 241; also, a connection part 211 is further concavely configured in the second case 21 in correspondence with the combination part 111 of the vibration body 1, the connection part 211 internally includes a second connection end 2111, and the first connection end 1111 and the second connection end 2111 can engage in contact to form an electric connection.

It should be understood that the touch electric circuit board 241 corresponds to the touch area 24 on one lateral surface of the second case 21, so it is possible to tab the touch area 24 in order to press on the touch electric circuit board 241, and the signals generated by pressing the touch electric circuit board 241 can be further transferred to the electric circuit board 22.

Meanwhile, the electric circuit board 22 is installed within the second case 21 and electrically connected to the second connection end 2111 and the touch electric circuit board 241, and the control body 2 can transfer information (implicitly including the audio signal and/or control signal) to the second connection end 2111 via the electric connection formed by the second connection end 2111 and the first connection end 1111 thus controlling the vibrator 12.

In addition, the inside of the electric circuit board 22 may optionally further include a wireless connection module (not shown) used to transfer the information, i.e., the audio signal and/or control signal, to the control body 2 in a wireless connection fashion.

Analogously, the inside of the electric circuit board 22 may optionally further include a wired connection plug (not shown) used to transfer the information, i.e., the audio signal and/or control signal, to the control body 2 in a wired connection fashion.

Furthermore, the first case and the second case can be designed to enable fixed or detachable connection, and, particularly by means of the detachable connection configuration, the control body 2 can be separated in order to perform electric recharging; in use, the combination part 111 and the connection part 211 can be combined for operation.

Besides, the surface on the other side of the first case 11 in the vibration body 1 is combined with a binding component 3 thereby allowing the contact board 121 of the vibrator 12 to be fixedly attached in binding onto the surface of the vibration board 4, in which the vibration board 4 may be a wooden board, a glass plate, a metal plate or a plastic board, and the surface thereof may be a flat surface or a non-flat surface.

Figure 5A:
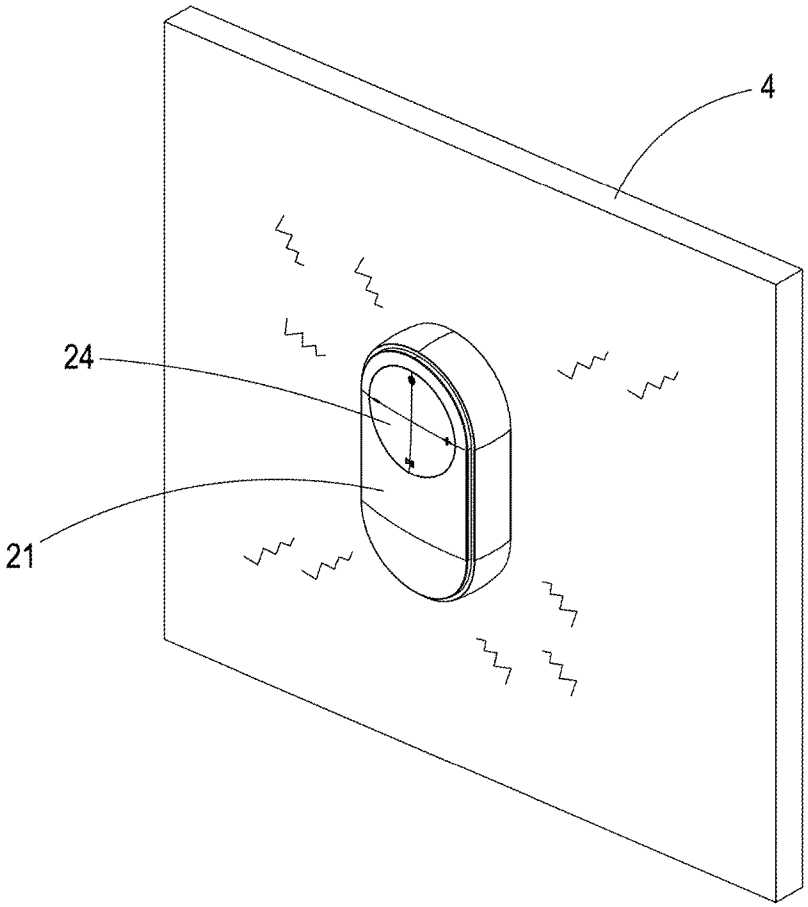
FIG. 5A shows an implementation view of the vibration-based speaker box device according to the present invention.
Figure 5B:
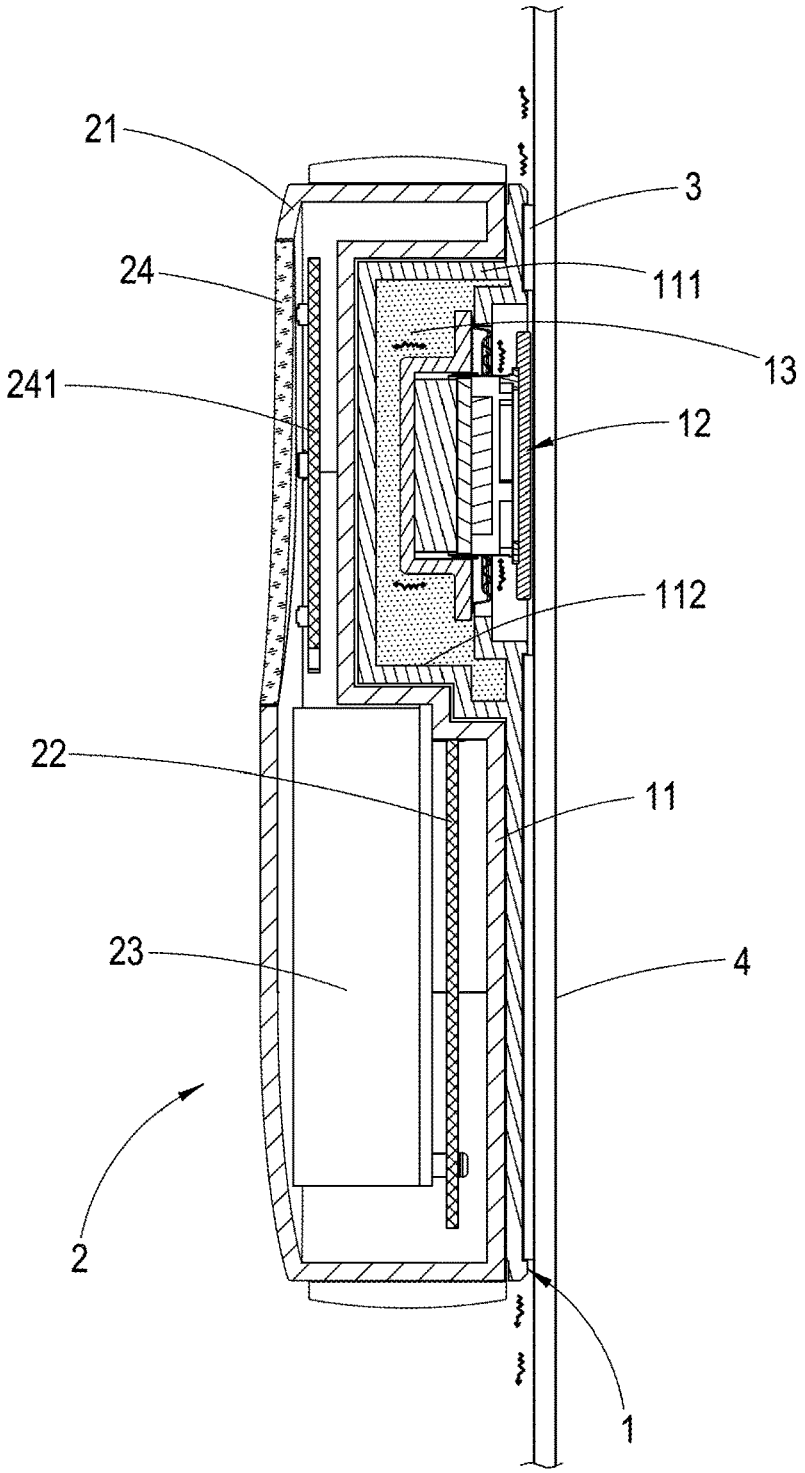
FIG. 5B shows an implementation view of the vibration-based speaker box device according to the present invention.

Next, FIGS. 5A and 5B show an implementation view in combination with the vibration board 4, and it can be appreciated that, when the sound coil 123 in the vibrator 12 drives the damper 124 to vibrate, the U-shaped iron 127 in the magnetic package is conjunctively brought to act such that the generated vibration can be transferred to the entire vibration body 1 through the filler 13, thereby allowing the vibration board 4 in contact with the vibrator 12 to distribute the kinetic energy coming from the vibrations of the vibration body 1 on the whole vibration board 4 so as to effectively enlarge its acoustic transfer range.

In comparison with other conventional technologies, the vibration-based speaker box device according to the present invention provides the following advantages:

(1) The present invention allows a surface having the vibrator to be fixed onto a vibration board, and when the vibrator vibrates, it is possible to spread out the generated vibrations on the vibration board via its fixed contact with the vibration board, so the acoustic transfer range thereof can be effectively increased.

(2) The present invention can achieve different levels of sound quality effects as well as transfer ranges in accordance with various materials of the vibration board.

(3) Since the present invention utilizes the filler to act as a sort of elastomer, the level of tightness existing between the filler and the vibrator may affect the vibration effects of the vibrator, thus further influencing the quality of sound transferred from the vibration board.

Certainly, it should be noticed that, although the present invention has been disclosed through the detailed descriptions of the aforementioned embodiments, such illustrations are by no means used to restrict the scope of the present invention; that is, skilled ones in relevant fields of the present invention can certainly devise any applicable alternations and modifications after having comprehended the aforementioned technical characteristics and embodiments of the present invention without departing from the spirit and scope thereof. Hence, the scope of the present invention to be protected under patent laws should be delineated in accordance with the claims set forth hereunder in the present specification.

What is claimed is:

1. A vibration-based speaker box device, comprising:

a vibration body, including:

a first case, formed with an accommodation area;

a vibrator, placed within the accommodation area and having at least a contact board, a supporting frame, a sound coil wound around the lateral surface of the supporting frame, a damper and a magnetic package, in which the lower part of the contact board is connected to the supporting frame, the supporting frame can be placed within the magnetic package, and one end of the damper is connected to the lateral surface of the supporting frame while the other end thereof is connected to the lateral edge of the magnetic package;

a filler, placed between the accommodation area and the vibrator so that, through which, the vibrator can be combined within the accommodation area;

in which the contact board of the vibrator can be fixedly bonded onto a vibration board and, after bringing the damper to vibrate by means of the sound coil of the vibrator, it is possible to make the magnetic package vibrate conjunctively, and the vibration can be further transferred to the entire vibration body via the filler such that the vibration board in contact with the vibrator can spread the kinetic energy generated by the vibrations of the vibration body onto the whole vibration board;

a control body, including:

a second case, connected to the first case;

an electric circuit board, set up within the second case and electrically connected to the vibrator of the vibration body;

a battery, installed within the second case and electrically connected to the electric circuit board;

in which the control body can send an audio signal to the vibration body so as to, by means of the vibrations of the vibration body, spread the audio signal through the vibration board.

2. The vibration-based speaker box device according to claim 1, wherein the contact board of the vibrator is a metal plate or a plastic board.

3. The vibration-based speaker box device according to claim 1, wherein the filler is a rubber, a sponge, an ethylene vinyl acetate copolymer, or a mixture containing at least two of the above-mentioned materials.

4. The vibration-based speaker box device according to claim 1, wherein the vibration board is a wooden board, a glass plate, a metal plate or a plastic board.

5. The vibration-based speaker box device according to claim 1, wherein the surface of the vibration board can be a flat surface or a non-flat surface.

6. The vibration-based speaker box device according to claim 1, wherein the surface on the other side of the first case in the vibration body is combined with a binding component thereby allowing the vibration body to be attached in binding onto the surface of the vibration board.

7. The vibration-based speaker box device according to claim 1, wherein a combination part protrudes outwards from one lateral surface of the first case in the vibration body, while an accommodation part is formed on the other lateral surface of the first case in the vibration body in correspondence with the combination part, and a connection part is further concavely configured on the control body in correspondence with the combination part of the vibration body, in which the connection part internally includes a second connection end.

8. The vibration-based speaker box device according to claim 7, wherein the vibrator of the vibration body is electrically connected to a first connection end, the electric circuit board of the control body is electrically connected to the second connection end, and the control body can transfer the audio signal to the second connection end via the connection of the second connection end and the first connection end.

9. The vibration-based speaker box device according to claim 1, wherein the first case and the second case can be fixedly connected or detachably connected.

10. The vibration-based speaker box device according to claim 1, wherein one side on the second case of the control body is further configured with a touch area which allows to be pressed thereby generating and transferring a signal to the electric circuit board.

11. The vibration-based speaker box device according to claim 1, wherein the inside of the electric circuit board further includes a wireless connection module and/or a wired connection plug which can be used to transfer information, which is the audio signals and/or control signals, to the control body by way of a wireless connection and/or a wired connection.

* * * * *